US008979236B1

(12) United States Patent
Idehara et al.

(10) Patent No.: US 8,979,236 B1
(45) Date of Patent: Mar. 17, 2015

(54) IMAGE FORMING APPARATUS

(71) Applicants: Ryoh Idehara, Kanagawa (JP); Kazuyoshi Kondo, Tokyo (JP)

(72) Inventors: Ryoh Idehara, Kanagawa (JP); Kazuyoshi Kondo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/472,446

(22) Filed: Aug. 29, 2014

(30) Foreign Application Priority Data

Sep. 13, 2013 (JP) ..... 2013-190777

(51) Int. Cl.
*B41J 29/38* (2006.01)
*B41J 13/00* (2006.01)

(52) U.S. Cl.
CPC ..... *B41J 13/0009* (2013.01)
USPC ..... 347/16; 347/104

(58) Field of Classification Search
CPC ..... B41J 3/4075; B41J 3/36; B41J 11/04; B41J 11/42; B41J 13/0009; B41J 13/0045; B41J 15/005
USPC ..... 347/5, 16, 101, 104–106, 153–154, 347/164–165
See application file for complete search history.

(56) References Cited

U.S. PATENT DOCUMENTS

2013/0108346 A1* 5/2013 Preliasco et al. ..... 400/611
2014/0028752 A1 1/2014 Kikura et al.
2014/0029023 A1 1/2014 Yanase et al.
2014/0078232 A1 3/2014 Kondo et al.
2014/0079461 A1 3/2014 Obata et al.
2014/0099148 A1 4/2014 Obata et al.
2014/0099150 A1 4/2014 Matsumoto et al.
2014/0105661 A1 4/2014 Kondo et al.

FOREIGN PATENT DOCUMENTS

JP 9-142431 6/1997
JP 2004-122494 4/2004
JP 2011-152670 8/2011
JP 2012-116641 6/2012
JP 2012-180223 9/2012

OTHER PUBLICATIONS

U.S. Appl. No. 14/205,865, filed Mar. 12, 2014.
U.S. Appl. No. 14/184,892, filed Feb. 20, 2014.

* cited by examiner

*Primary Examiner* — Thinh Nguyen
(74) *Attorney, Agent, or Firm* — Cooper & Dunham LLP

(57) ABSTRACT

An image forming apparatus includes a media roll, an image forming device, a conveyance unit, and a controller. In the roll, a printing medium having an adhesive face and no separation sheet on the adhesive face is wound in a roll shape. In pulling back the medium to the roll, the controller sets a linear velocity of the roll to be not lower than a linear velocity of a conveyance rotator of the conveyance unit. The controller controls a velocity difference between the roll and the rotator to be Va from a start of pulling back the medium to when a separation point of the medium from the roll reaches a tangent line of the roll in an area between the roll and the rotator. When the separation point reaches the tangent line, the controller switches the velocity difference from Va to Vb that is smaller than Va.

5 Claims, 7 Drawing Sheets

IMAGE FORMING APPARATUS

CROSS-REFERENCE TO RELATED APPLICATIONS

This patent application is based on and claims priority pursuant to 35 U.S.C. §19(a) to Japanese Patent Application No. 2013-190777, filed on Sep. 13, 2013, in the Japan Patent Office, the entire disclosure of which is hereby incorporated by reference herein.

BACKGROUND

1. Technical Field

Embodiments of this disclosure relate to an image forming apparatus, and more specifically to an image forming apparatus using a rolled printing medium with an adhesive face.

2. Description of the Related Art

Image forming apparatuses are used as printers, facsimile machines, copiers, plotters, or multi-functional devices having, e.g., two or more of the foregoing capabilities. As one type of image forming apparatuses, for example, an image forming apparatus, such as a label printer, is known that prints a rolled printing medium having an adhesive face on which a separation sheet is attached (hereinafter, also referred to as "linerless label sheet"), such as a label sheet having no tape or mount sheet, and cuts the printing medium to a desired length after printing to form a printing medium piece (hereinafter, "label piece").

Such an image forming apparatus using a rolled printing medium has a cutting unit to cut the recording medium in response to a user's request.

To prevent waste of a recording medium caused by cutting the recording medium at a downstream side of an image forming unit, for example, an image forming apparatus returns the recording medium in a direction opposite a discharge direction of the recording medium before the next printing, and place the leading end of the recording medium at a position for the next printing.

In such a case, typically, the image forming apparatus returns the recording medium to the position while applying tension to the recording medium.

BRIEF SUMMARY

In at least one embodiment of this disclosure, there is provided an image forming apparatus including a media roll, an image forming device, a conveyance unit, and a controller. In the media roll, a printing medium having an adhesive face and no separation sheet on the adhesive face is wound in a roll shape. The image forming device forms an image on the recording medium. The conveyance unit includes a conveyance rotator to convey the printing medium. The controller controls the conveyance rotator and the media roll to rotate in reverse and pull back the printing medium to the media roll. In pulling back the printing medium to the media roll, the controller sets a linear velocity of the media roll in a rotation direction of the media roll to be not lower than a linear velocity of the conveyance rotator in a rotation direction of the conveyance rotator. The controller controls a velocity difference between the linear velocity of the media roll and the linear velocity of the conveyance rotator to be Va from a start of pulling back the printing medium to when a separation point of the printing medium from the media roll reaches a tangent line of the media roll in an area between the media roll and the conveyance rotator. When the separation point of the printing medium reaches the tangent line of the media roll, the controller switches the velocity difference from Va to Vb that is a smaller velocity difference than Va.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
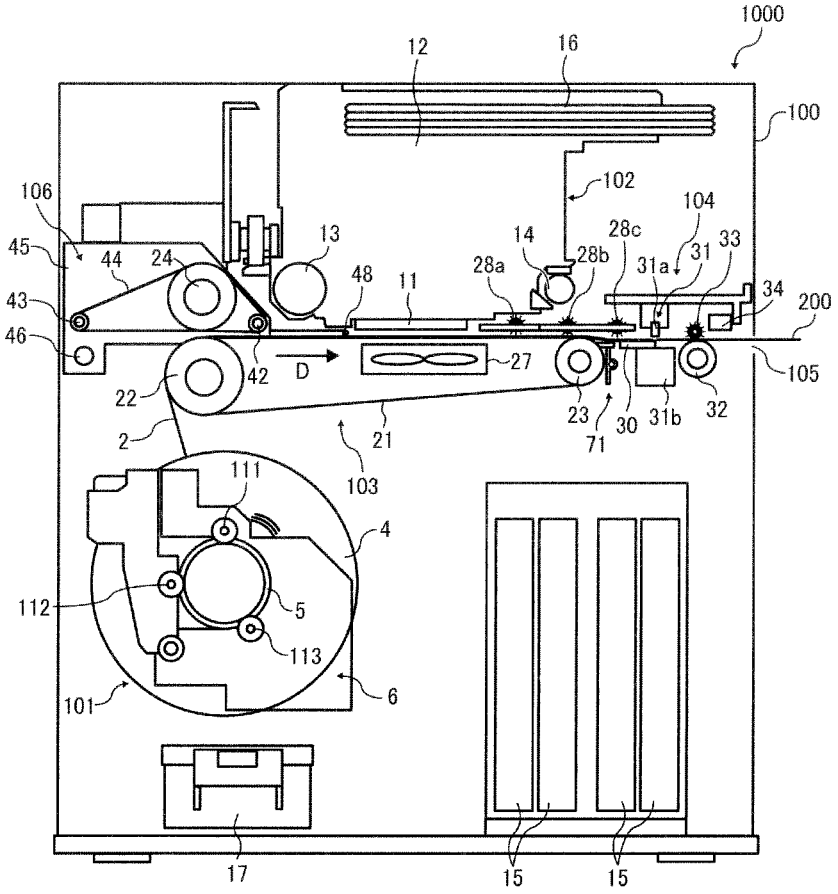
FIG. 1 is a front view of a mechanical section of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "image formation" used herein includes providing not only meaningful images, such as characters and figures, but meaningless images, such as patterns, to e (in other words, the term "image formation" also includes causing liquid droplets to land on printing media).

The term "ink" is not limited to "ink" in a narrow sense, unless specified, but is used as a generic term for any types of liquid usable as targets of image formation. For example, the term "ink" includes recording liquid, fixing solution, liquid, and so on.

The term "image forming apparatus", unless specified, also includes both serial-type image forming apparatus and line-type image forming apparatus.

Although the embodiments are described with technical limitations with reference to the attached drawings, such description is not intended to limit the scope of the disclosure and all of the components or elements described in the embodiments of this disclosure are not necessarily indispensable.

When a linerless label sheet is used as a recording medium, the recording medium is conveyed while being peeling off from a media roll. Accordingly, when an image is formed on the recording medium conveyed from the media roll, the recording medium is drawn out from the media roll in a normal direction of the roll media.

By contrast, when the media roll and a conveyance unit are rotated in reverse to wind back the recording medium, the recording medium is wound back to the media roll from a tangent direction of the media roll.

Here, a rotation distance of the media roll from a first position at which the recording medium is drawn out from the media roll in the normal direction to a second position at which the recording medium is returned to the media roll in the normal direction is greater than a difference in the distance from the media roll to the conveyance unit between in the normal direction and in the tangent direction.

Accordingly, when the media roll and the conveyance unit are rotated at substantially the same linear velocity, the recording medium loses tension between the media roll and the conveyance unit. If the recording medium is wound back in a slacked state, the recording medium is likely to be wrinkled, affecting the next printing operation.

To deal with the above-described problem, it is conceivable to rotate the media roll at a higher linear velocity to apply more tension to prevent slack of the recording medium. However, after the recording medium reaches the tangent direction of the media roll at which a feed amount for returning the recording medium becomes equivalent between the conveyance unit and the media roll, the difference in linear velocity between the conveyance unit and the media roll would be too large, thus causing an increased driving load or a shift between the conveyance unit and the recording medium.

Hence, according to at least one embodiment of this disclosure, an image forming apparatus can perform stable conveyance without shift between the conveyance unit and the printing medium 2 while reducing occurrence of wrinkles due to pull-back operation of the printing medium 2.

Referring now to the drawings, wherein like reference numerals designate identical or corresponding parts throughout the several views, embodiments of the present disclosure are described below.

First, an image forming apparatus according to an embodiment of this disclosure is described with reference to FIGS. 1 and 2.

FIG. 1 is a front view of a mechanical section of an image forming apparatus 1000 according to an embodiment of this disclosure. FIG. 2 is a partial front view of the mechanical section with a printing medium.

As illustrated in FIG. 1, the image forming apparatus 1000 has a sheet feeding unit 101 serving as a sheet feeder, an image forming unit 102 as an image forming device, a conveyance unit 103 as a conveyor, and a discharge conveyance unit 104 as a discharge conveyor within an apparatus body 100. The image forming apparatus 1000 also has a discharge port 105 and a guide unit 106. The discharge port 105 serves as a discharge port part to discharge a printing medium 2 having an image formed thereof to the outside of the apparatus body 100. The guide unit 106 guides a rolled printing medium 2 during conveyance and pull-back of the printing medium 2.

A media roll 4 formed of the rolled printing medium 2 is loaded on the sheet feeding unit 101.

Figure 2:
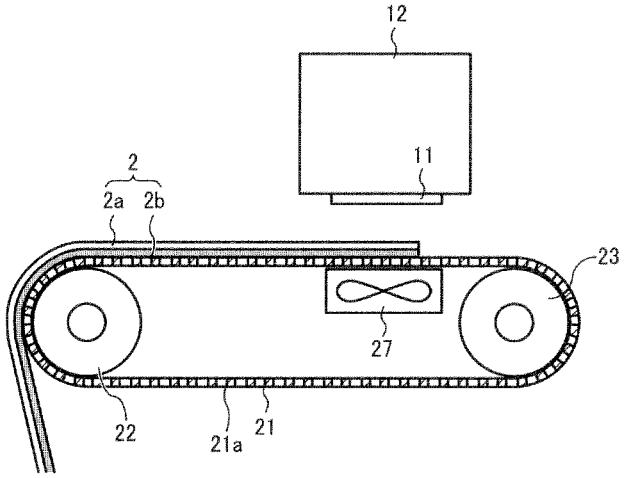
FIG. 2 is a partial front view of the image forming apparatus of FIG. 1.

As illustrated in FIG. 2, the printing medium 2 is a continuum having an image-formable medium (hereinafter, also referred to as "printing face") 2*a* and an adhesive layer (hereinafter, referred to as "adhesive face") 2*b* formed on a surface of the image-formable medium 2*a*. The printing medium 2 is a linerless label sheet rolled around in a state in which a mount sheet (separation sheet or separator) is not adhered to the adhesive face 2*b*.

The media roll 4 is engaged with a spool 5. Each of opposed ends of the spool 5 is rotatably held at three points, i.e., by a first roller 111, a second roller 112, and a third roller 113 serving as a first rotary body, a second rotary body, and a third rotary body, respectively.

The term "spool" used herein is not limited to a member that is provided separately from a core member and engaged with the core member for use. The spool may be held by roll holder members 6 as an integral part of the core member of the media roll 4. In a case in which the core member of the media roll 4 is directly held, the term "spool" includes the core member.

The image forming unit 102 includes a recording head 11 and a carriage 12. The recording head 11 is a liquid ejection head mounted on the carriage 12 to eject droplets onto a printing medium 2. The carriage 12 is supported by guide members 13 and 14 so as to be reciprocally movable along a direction (main scanning direction) perpendicular to a conveyance direction of the printing medium 2 indicated by arrow D in FIG. 1. Thus, the recording heads 11 are reciprocally movable in the main scanning direction.

For this embodiment, a liquid ejection head having two nozzle rows is used as the recording head 11, and the carriage 12 mounts two recording heads 11. The two recording heads 11 eject ink droplets of, for example, black (K), cyan (C), magenta (M), and yellow (Y) from four nozzle rows. It is to be noted that the configuration of the recording head is not limited to the above-described configuration but may be other type of recording head, for example, a line-type recording head.

Ink cartridges 15 storing respective color inks are mounted to the apparatus body 100 in a replaceable manner. The color inks are supplied from the ink cartridges 15 to via supply tubes 16 to head tanks mounted on the carriage 12, and further supplied from the head tanks to the recording heads 11.

The image forming apparatus 1000 also has a waste liquid tank 17 mounted to the apparatus body 100 in a replaceable manner. For example, in a maintenance operation for maintaining and recovering the performance of the recording heads 11, waste ink is discharged into and stored in the waste liquid tank 17.

The image forming unit 102 is not limited to the above-described liquid ejection head but may be any other type of image forming unit to form an image in a contact or non-contact manner.

The conveyance unit 103 includes a protection belt 21 as belt member which is an endless protection member. The protection belt 21 is dispose below the recording heads 11. The protection belt 21 is looped around a conveyance roller 22 and a tensioned driven roller 23 so as to circulate.

The protection belt 21 preferably has no adhesion to the adhesive face 2*b*. However, to prevent the printing medium 21 from floating up from the protection belt 21 during conveyance, the protection belt 21 may have such low adhesion to the adhesive face 2*b* that the protection belt 21 is separatable from the adhesive face 2*b*. Pressing the protection belt 21 against the adhesive face 2*b* allows protection of the adhesive face 2*b* and prevents the adhesive face 2*b* from contacting components inside the image forming apparatus to allow stable conveyance of the printing medium 2. In addition, since the protection belt 21 is separatable from the adhesive face 2*b*, the printing medium 2 separated from the protection belt 21 is discharged from the discharge port 105.

In other words, in this embodiment, the protection belt 21 protects the adhesive face 2*b* of the printing medium 2 and is transported together with the printing medium 2.

An opposing roller 24 is disposed opposing the conveyance roller 22. A conveyance roller pair (in this embodiment, pair of rotary bodies) of the conveyance roller 22 and the opposing roller 24 constitutes a conveyor to sandwich the printing medium 2 and the protection belt 21 together and convey the printing medium 2 to an image forming region of the recording heads 11.

The protection belt 21 has multiple holes. Within a loop formed by the protection belt 21, a suction fan 27 is disposed opposing the recording heads 11 of the image forming unit 102. The suction fan 27 sucks the printing medium 2 toward a surface of the protection belt 21 via the suction holes.

In the above-described configuration, the printing medium 2 is adhered onto the protection belt 21 by suction of air. It is to be noted that the force to adhere the printing medium to the protection belt is not limited to air suction but, for example, electrostatic force may be used to adhere the printing medium onto the protection belt. Alternatively, for example, the printing medium may be supported and guided with a conveyance guide member (e.g., platen member) without using the protection member.

In addition, spur roller units 28*a*, 28*b*, and 28*c* are disposed near the driven roller 23. Each of the spur roller units 28*a*, 28*b*, and 28*c* has multiple spur rollers arranged in the direction perpendicular to the conveyance direction D. The upstream spur roller units 28*a* and 28*b* are disposed opposing the protection belt 21, and the most downstream spur roller unit 28*c* is disposed opposing a receive member 30 of the discharge conveyance unit 104.

A separation unit 71 is disposed downstream from the driven roller 23 to separate the printing medium 2 from the protection belt 21.

The receive member 30 guides the printing medium 2 fed from between the protection belt 21 and the spur roller unit 28*b*. The discharge conveyance unit 104 has a cutter unit 31 serving as a cutting device to cut a printing medium 2 into a desired length to form a printing medium piece (label piece) 200. The discharge conveyance unit 104 is disposed downstream from the receive member 30 in the conveyance direction D of the printing medium 2.

The cutter unit 31 includes a lower blade 31*b* and a cutting blade (upper blade or cutter) 31*a*. The lower blade 31*b* is formed at a downstream edge surface of the receive member 30. The cutter 31*a* cuts the printing medium 2 between the lower blade 31*b* and the cutter 31*a*. The cutter 31*a* is moved in the direction perpendicular to the conveyance direction D to cut the printing medium 2.

A discharge roller 32 is disposed downstream from the cutter unit 31, in other words, downstream from the protection belt 21 serving as the belt member in the conveyance direction D. A spur roller 33 is disposed opposing the discharge roller 32 and presses the printing medium 2 against the discharge roller 32. The discharge roller 32 and the spur roller 33 hold the label piece 200, which is cut by the cutter unit 31, in a state in which a leading end of the label piece 200 is sent out to the discharge port 105 serving as a discharge port part of the apparatus body 100.

In this embodiment, a surface of the discharge roller 32 to hold the label piece 200 is, for example, non-adherence processed (processed so that the adhesive surface 2*b* does not adhere to the surface of the discharge roller 32), thus allowing separation of the adhesive surface 2*b* of the label piece 200. In some embodiments, the discharge roller 32 itself may be made of a material allowing separation of the adhesive surface 2*b* of the label piece 200.

A sheet sensor 34 is disposed to detect presence or absence of a printing medium 2. The sheet sensor 34 is constituted of, for example, a photosensor or a combination of a mechanical lever and a photosensor.

On a downstream side of the opposing roller 24 also serving as the first roller constituting the conveyance unit 103, the guide unit 106 has a second roller 42 serving as a separation roller disposed upstream from the image forming unit 102 and a third roller 43 disposed opposing the second roller 42 via the opposing roller 24. An endless guide belt 44 is looped around the opposing roller 24, the second roller 42, and the third roller 43. The guide unit 106 also has a front-end press roller 48 to press the printing medium 2 at a position upstream from the recording heads 11 in the conveyance direction D.

The guide belt 44 is a belt member having a base member made of, e.g., polyimide and a release layer (e.g., silicone coating) as a surface layer to enhance the release performance of the guide belt 44.

The opposing roller 24, the second roller 42, and the third roller 43 are rotatably held by a holder member 45. The holder member 45 is rotatable around a shaft 46 and is displaceable between at a position at the opposing roller 24 opposes the conveyance roller 22 and a position at which the opposing roller 24 separates from the conveyance roller 22 to open a space between the opposing roller 24 and the conveyance roller 22.

When the media roll 4 is loaded and the printing medium 2 is set on the protection belt 21, the space between the opposing roller 24 and the conveyance roller 22 is opened. When the printing medium 2 is conveyed, the opposing roller 24 is pressed toward the conveyance roller 22. Accordingly, the opposing roller 24 is pressed toward the conveyance roller 22 by a pressing unit, such as a spring. In addition, the second roller 42 is pressed toward the protection belt 21 by a pressing unit, such as a spring.

For the image forming apparatus 1000 having such a configuration, the protection belt 21 and the printing medium 2 pulled out from the media roll 4 loaded on the sheet feeding unit 101 are sandwiched together between the conveyance roller 22 and the opposing roller 24.

When the conveyance roller 22 is rotated, the printing medium 2*b* and the protection belt 21 are conveyed together in a state in which the adhesive face 2*b* is protected by the protection belt 21. A desired image is formed on the printing medium 2 by the recording heads 11 of the image forming unit 102.

When the protection belt 21 is separated from the printing medium 2 having the image formed thereon, the printing medium 2 is conveyed to the discharge conveyance unimt 104 and cut at a desired position by the cutter unit 31 to form a label piece 200. The label piece 200 is held between the discharge roller 32 and the spur rollers 33 in a state in which the label piece 200 is extractable from the discharge port 105 of the apparatus body 100.

The guide unit 106 also prevents the printing medium 2 from being reeled by the opposing roller 24 during conveyance and pull-back of the printing medium 2, in particular, when an image is formed on the adhesive face 2*b* of the printing medium 2.

In other words, even if the surface of the opposing roller 24 is processed for non-adhesion, the adhesive face 2*b* of the printing medium 2 might adhere to the circumferential surface of the opposing roller 24 and be reeled by the opposing roller 24 due to a small curvature of the opposing roller 24. In such a case, it is conceivable to use a larger curvature of the opposing roller 24. However, a larger curvature of the opposing roller 24 reduces the size of a nip area between the opposing roller 24 and the conveyance roller 22, thus preventing obtainment of stable conveyance force.

Hence, during conveyance, the printing medium 2 is conveyed while being pressed by the guide belt 44, and the guide belt 44 is reliably separated from the printing medium 2 by the second roller 42 serving as a separation roller having a large curvature, thus preventing the printing medium 2 from being reeled by the opposing roller 24 during conveyance.

When the printing medium 2 is pulled back, the guide belt 44 receives the adhesive face 2*b* of the printing medium 2, thus preventing the printing medium 2 from being reeled by the opposing roller 24.

When image formation is finished and the printing medium 2 is cut by the cutter unit 31, the leading end of the printing medium 2 is at the position of the cutter unit 31 and an area of the printing medium 2 opposite the image forming unit 102 is an unused area. In such a state, if the next image forming operation is resumed, the unused area of the printing medium 2 is wasted. Hence, in this embodiment, the pnnting medium 2 is pulled back in a pull-back direction (opposite the conveyance direction of the printing medium 2) to a position at which the leading end of the printing medium 2 is placed upstream from the image forming unit 102 in the conveyance direction.

Next, driving systems of the sheet feeding unit and the conveyance unit are described with reference to FIG. 3.

Figure 3:
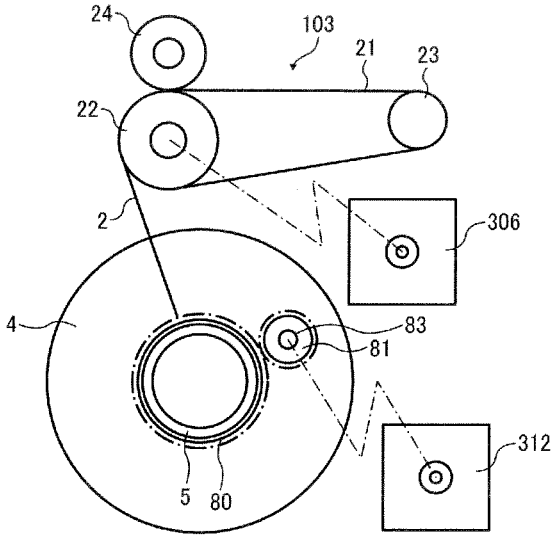
FIG. 3 is a schematic view of driving systems of a sheet feeding unit and a conveyance unit of the image forming apparatus.

FIG. 3 is a schematic view of the driving systems according to this embodiment.

The sheet feeding unit 101 has a sheet feeding motor 312. A gear 80 serving as a rotation transmitter is mounted on the spool 5, and a driving gear 81 is mounted on the apparatus body 100. The sheet feeding motor 312 rotates the driving gear 81 via a drive force transmission system including, e.g., a gear train and a timing belt. With the rotation of the driving gear 81, the spool 5 is rotated and the media roll 4 is rotated.

The driving gear 81 has a built-in torque limiter 83. When the driving gear 81 receives a torque equal to or greater than a threshold value from the media roll 4, the driving gear 81 stops the drive transmission.

The conveyance unit 103 includes a conveyance motor 306. Rotation of the conveyance motor 306 is transmitted to the conveyance roller 22 serving as a conveyance rotator via a drive force transmission system including, e.g., a gear train and a timing belt.

In this embodiment, a driving source (the sheet feeding motor 312) to rotate the media roll 4 is separately provided from a driving source (the conveyance motor 306) to rotate the conveyance roller 22. Such a configuration can set the conveyance roller 22 and the media roll 4 at different velocities and change the velocities to rotate he conveyance roller 22 and the media roll 4.

Next, a media-roll remaining amount detector serving as a remaining-amount detection unit to detect a remaining amount of the media roll 4 is described with reference to FIG. 4.

Figure 4:
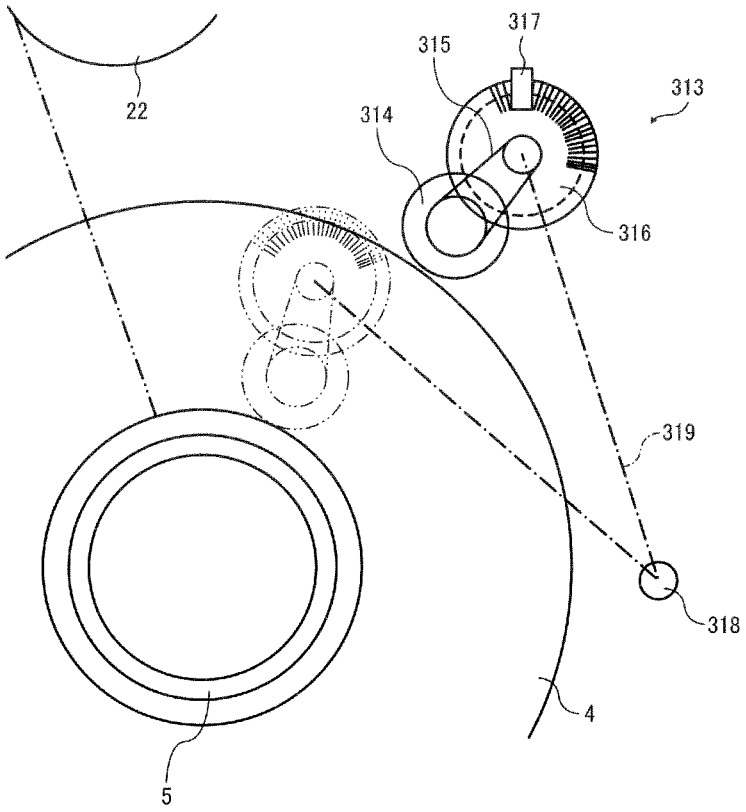
FIG. 4 is a schematic view of a media-roll remaining amount detector according to an embodiment of this disclosure.

FIG. 4 is a schematic view of a media-roll remaining amount detector 313 according to an embodiment of this disclosure.

The media-roll remaining amount detector 313 serving as the remaining-amount detection unit includes a roller 314 to contact a circumferential surface of the media roml 4, a belt 315 to transmit rotation of the roller 314, an encoder wheel 316 to receive the transmission of rotation of the roller 314 via the belt 315, and an encoder sensor 317 to read the encoder wheel 316.

A holder 319 (indicated by broken lines for convenience of illustration in FIG. 4) holds the roller 314, the belt 315, the encoder wheel 316, and the encoder sensor 317. The holder 319 is rotatable around a rotation shaft 318. The holder 319 is pressed toward the media roll 4 so that the roller 314 moves in response to a decrease in outer diameter of the media roll 4.

Here, since the outer diameter of the roller 314 and the rotation speed of the sheet feeding motor 312 are known, the main controller 312 calculates the outer diameter of the media roll 4 from an output value of the encoder sensor 317.

It is to be noted that the remaining-amount detection unit may be any other suitable configuration, for example, a displacement sensor, an optical detection unit including a feeler, or a detection unit including a variable resistance board.

Figure 5:
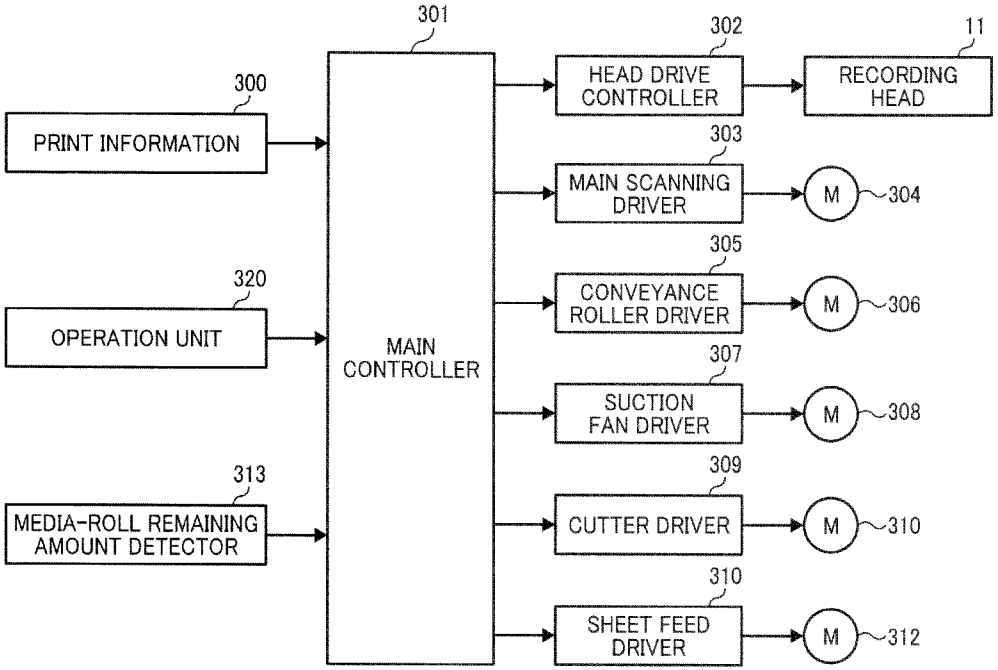
FIG. 5 is a block diagram of a controller according to an embodiment of this disclosure.

Next, an outline of a control unit of the image forming apparatus according to an embodiment of this disclosure is described with reference to FIG. 5.

The control unit includes, e.g., a main controller 301 also serving as a controller according to this embodiment, a head drive controller 302, a main scanning driver 303, a conveyance roller driver 305, a suction fan driver 307, a cutter driver 309, and a sheet feed driver 311.

The main controller 301 includes, e.g., a central processing unit (CPU), a read-only memory (ROM), a random access memory (RAM), an input-and-output unit (I/O), other microcomputers, a volatile random access memory (VRAM), and an application-specific integrated circuit (ASIC).

Print information 300 is input from a host to the main controller 301.

To form an image on a recording medium 2 in accordance with the print information 300, the main controller 301 controls driving of the conveyance motor 306 via the conveyance roller driver 305 and rotates the conveyance roller 22 to intermittently convey the printing medium 2 while drawing the printing medium 2 from the media roll 4. The main controller 301 controls driving of the main scanning motor 304 via the main scanning driver 303 and controls driving of the recording heads 11 via the head drive controller 302 while moving the carriage 12 for scanning in the main scanning direction, to eject desired droplets from the recording heads 11.

When the conveyance roller 22 is rotated to feed the printing medium 2, the main controller 301 controls driving of a suction fan motor 308 via the suction fan driver 307 to rotate the first thermistor 27, thus adheres the printing medium 2 onto the protection belt 21.

When driving of the conveyance roller 22 is transmitted, the conveyance motor 306 is rotated to rotate the discharge roller 32.

The main controller 301 drives the cutter motor 310 via the cutter driver 309 to move a cutter 31*a* of the cutter unit 31 in the main scanning direction and thus cuts the recording medium 2 having an image formed thereon at a desired length into a printing medium piece (label pieces) 200.

The main controller 301 rotates the sheet feeding motor 312 via the sheet feed driver 311 to rotate the spool 5, thus rotating the media roll 4. When the media roll 4 is rotated in reverse to wind (pull) back the printing medium 2, the main controller 301 controls pull-back operation in accordance with detection results of the media-roll remaining amount detector 313.

The main controller 301 is connected to an operation panel (operation unit) 320.

Next, pull-back operation controlled by the main controller according to an embodiment of this disclosure is described with reference to FIGS. 6A and 6B.

Figure 6B:
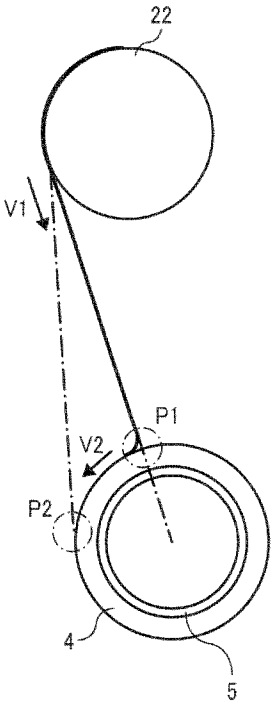
FIGS. 6A and 6B is a schematic view of pull-back operation of the controller.
Figure 6A:
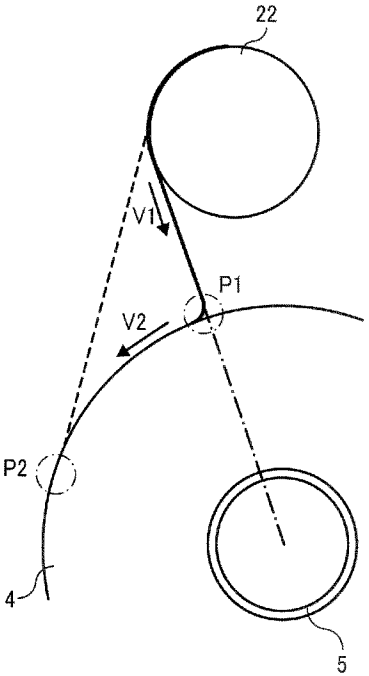

FIGS. 6A and 6B are schematic views of pull-back operation according to this embodiment. FIG. 6A shows a state in which the remaining amount of the media roll 4 is large. FIG. 6B shows a state in which the remaining amount of the media roll 4 is small.

As described above, after an image is formed on a printing medium 2 and the cutter unit 31 cuts the printing medium 2, the main controller 301 conducts pull-back operation of pulling the leading end of the printing medium 2 to a position upstream from the recording heads 11 in the medium conveyance direction D a by rotating the conveyance roller 22 in reverse.

Here, since the printing medium 2 is wound around with no separator on the adhesive face 2*b*, the printing medium 2 is fed while being peeled off from the developing device 4 during image forming operation. At this time, the direction in which the printing medium 2 is drawn out from the media roll 4 is a normal direction of the media roll 4, and a separation point (separation position) of the printing medium 2 is a position P1 illustrated in each of FIGS. 6A and 6B.

By contrast, when the printing medium 2 is pulled back to the media roll 4 while being wound around the media roll 4, the separation point of the printing medium 2 moves from the position P1 to a position P2 (tangent position of the media roll 4) with rotation of the media roll 4. At the position P2, winding of the printing medium 2 to the media roll 4 is started.

Here, if the recording medium 2 is a general sheet of paper, the separation point of which is also the position P2 when drawn out from the media roll 4, there is no difference in the separation point of the recording medium 2 between when the printing medium 2 is pulled out from the media roll 4 and when the printing medium 2 is pulled back to the media roll 4. Accordingly, the printing medium 2 is pulled back so that the linear velocity at which the printing medium 2 is pulled back by the media roll 4 is substantially equivalent to the linear velocity at which the printing medium 2 is pulled back by reverse rotation of the conveyance roller 22.

However, for the printing medium 2 having the adhesive face 2*b*, as described above, the separation point moves from the position P1 to the position P2 when the printing medium 2 is pulled back. At this time, when the linear velocity of rotation is the same between the media roll 4 and the conveyance roller 22, the printing medium 2 is fed from the conveyance roller 22 to the media roll 4 by the same distance as the distance at which the separation point of the printing medium 2 from the media roll 4 moves from the position P1 to the position P2.

However, a distance between a distance from the conveyance roller 22 to the position P2 (indicated by a broken line in each of FIGS. 6A and 6B) and a distance from the conveyance roller 22 to the position P1 (indicated by a solid line in each of FIGS. 6A and 6B) is smaller than the distance fed from the conveyance roller 22 to the media roll 4 (a distance on the media roll 4 from the position P1 and the position P2).

As a result, the printing medium 2 is wound back with a slack between the conveyance roller 22 and the media roll 4 and is likely to be wrinkled.

Hence, for the control of pull-back operation according to this embodiment, while the separation point of the printing medium 2 from the media roll 4 moves from the position P1 to the position P2, a linear velocity V2 of the media roll 4 in a pull-back rotation direction is set to be greater than a linear velocity V1 of the conveyance roller 22 in a roll-back rotation direction (V2>V1).

Such control reduces a slack arising when the printing medium 2 is pulled back, thus reducing occurrence of wrinkles.

However, when the printing medium 2 is conveyed at such a linear velocity difference that the printing medium 2 is not slacked, a relatively large difference between the media roll 4 and the conveyance roller 22 may occur after the printing medium 2 reaches the tangent direction of the media roll, thus causing an increased driving load of the media roll 4 having a greater linear velocity or a shift between the protection belt 21 and the printing medium 2.

Hence, for the control of pull-back operation according to this embodiment, until the separation point of the printing medium 2 from the media roll 4 reaches the tangent direction of the media roll 4 between the media roll 4 and the conveyance roller 22, the printing medium 2 is conveyed so that the difference between the linear velocity of the media roll 4 in the rotation direction and the linear velocity of the conveyance rotation (the conveyance roller 22) in the rotation direction is Va. When the separation point reaches the tangent direction, the difference between the linear velocity of the media roll 4 in the rotation direction and the linear velocity of the conveyance rotation (the conveyance roller 22) in the rotation direction is switched to be Vb (Va>Vb).

Here, the meaning of the words "when the separation point reaches the tangent direction" is not limited to a moment at which the printing medium 2 reaches the tangent direction but may be before or after the printing medium 2 reaches the tangent direction if the printing medium 2 is placed near the tangent direction.

Such control allows stable conveyance without shift between the conveyance unit and the printing medium 2 while reducing occurrence of wrinkles due to pull-back operation of the printing medium 2.

Here, for the switching of the linear velocity, the linear velocity of the conveyance roller 22 may be switched. Alternatively, the linear velocity of the media roll 4 may be switched. For the switching time, for example, the linear velocity of the media roll 4 or the conveyance roller 22 may be switched when the position of the printing medium 2 is detected with, e.g., an optical sensor or a contact-type sensor provided in the tangent direction of the media roll 4 or when a detected torque of the media roll 4 rises.

Alternatively, the time in which the separation point of the printing medium 2 from the media roll 4 moves from the position P1 to the position P2 may be calculated from the distance between the position P1 and the position P2 and the linear velocity of the media roll 4 in the rotation direction to switch the linear velocity after the calculated time has passed.

Here, the time (hereinafter, separation-point moving time) in which the separation point of the printing medium 2 from the media roll 4 moves from the position P1 to the position P2 changes with the diameter of the media roll 4. The diameter of the media roll 4 changes with the remaining amount of the media roll 4. Accordingly, based on detection results of the media-roll remaining amount detector 313 described above, the main controller 301 control calculation of the separation-point moving time from the position P1 to the position P2.

Alternatively, instead of such control, the above-described torque limiter may be used to rotate the media roll 4 at the same linear velocity so that the media roll 4 follows the conveyance roller 22 after the printing medium 2 is tensioned in the tangent direction of the media roll 4 and the torque of the driving gear 81 increases.

Figure 7:
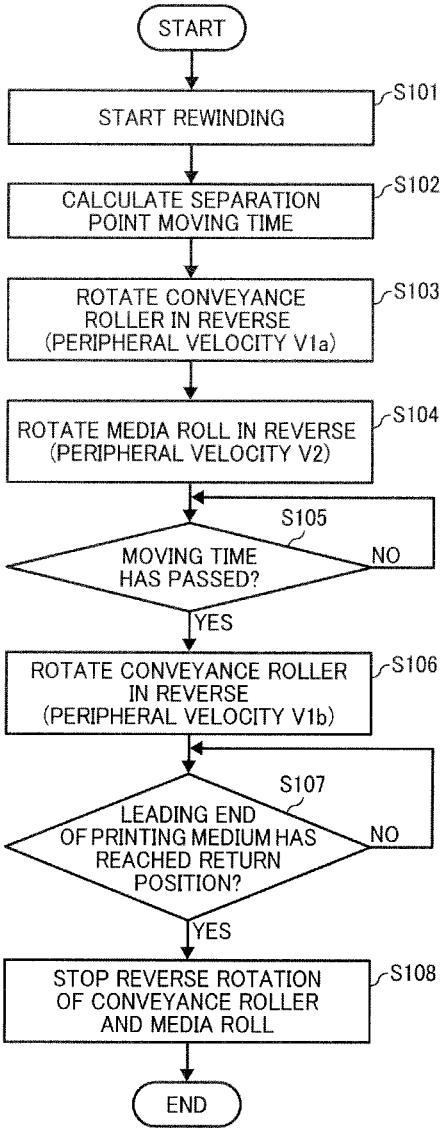
FIG. 7 is a flow chart of pull-back control according to an embodiment of this disclosure.

Next, pull-back control performed by the main controller according to an embodiment of this disclosure is described with reference to FIG. 7.

At S101, when pull-back operation (rewinding) is started, the main controller 301 determines the remaining amount of the media roll 4 from detection results of the media-roll remaining amount detector 313 and calculates the separationpint moving time at which the separation point of the printing medium 2 from the media roll 4 moves from the position P1 to the position P2 (S102).

At S103, the main controller 301 controls the conveyance motor 306 to rotate in reverse and the conveyance roller 22 to pull back the printing medium 2 at a velocity V1 (peripheral velocity V1 of the conveyance roller 22). At S104, the main controller 301 controls the sheet feeding motor 312 to rotate in reverse and the media roll 4 to pull back the printing medium 2 at a velocity V2 (peripheral velocity V2 of the media roll 4) (V2>V1).

As a result, as described above, the moving amount with rotation of the media roll 4 becomes greater than the feed amount of the printing medium 2 per unit time from the conveyance roller 22 to the media roll 4. Such control can reduce a slack of the printing medium 2 caused by a change in conveyance direction between the media roll 4 and the conveyance roller 22 due to the movement of the separation posing from the position P1 to the position P2.

When the separation-point moving time has passed (YES at S105), in other words, the printing medium 2 is placed at a position at which the printing medium 2 is drawn out in a tangent direction of the media roll 4, at S106, the main controller 301 controls the conveyance roller 22 to rotate in reverse and pull back the printing medium 2 at a velocity V1b (peripheral velocity V1b of the conveyance roller 22) (V2≤V1b>V1).

As described above, such control prevents excessive tension from applying from the conveyance roller 22 to the printing medium 2, reduces driving load, and prevents occurrence of shift between the conveyance roller 22 and the printing medium 2.

When the leading end of the printing medium 2 reaches a return position (YES at S107), at S108 the main controller 301 stops reverse rotation of the conveyance roller 22 and the media roll 4 and finishes the process.

In this control, the velocity of the conveyance roller 22 is changed between in the separation-point moving time and after the separation-point moving time has passed. It is to be noted that the velocity of the media roll 4 may be changed to decrease the rotation speed of the media roll 4 after the separation-point moving time has passed.

Figure 8:
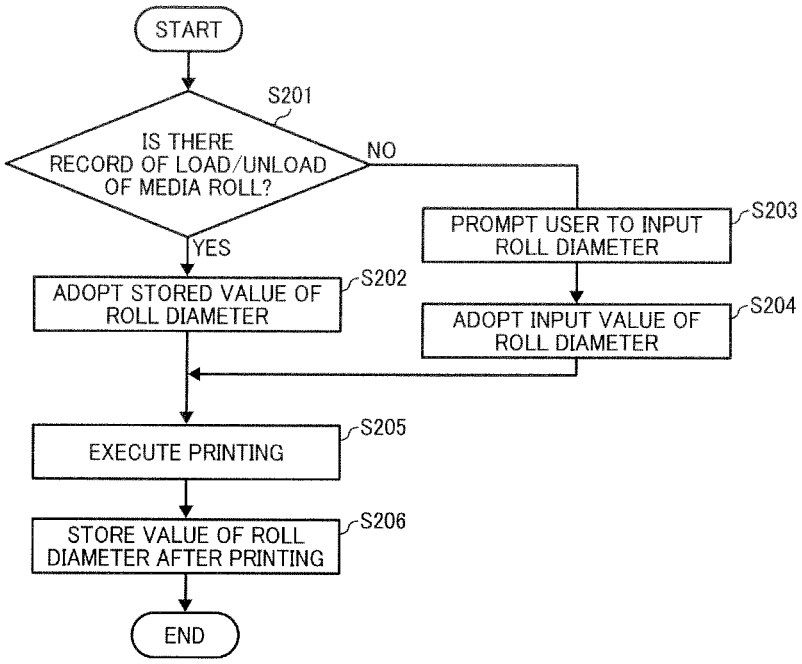
FIG. 8 is a flow chart of a media-roll remaining amount detection process conducted by the controller according to an embodiment of this disclosure.

Next, a media-roll remaining amount detection process according to an embodiment of this disclosure is described with reference to FIG. 8.

In this embodiment, at S201 the main controller 301 determines presence or absence of records of load and unload of a media roll. When the record is present (YES at S201), at S202 the main controller 301 adopts a stored value of the diameter of the media roll. At S205, the main controller 301 executes printing. At S206, the main controller 301 calculates the diameter of the media roll 4 after printing from the amount of the printing medium 2 used by printing and the thickness of the printing medium 2, and stores a calculated value of the diameter of the media roll 4 for calculation of the separation-point moving time in pull-back operation.

By contrast, when the records of load and unload of the media roll 4 is absent, at S203 the main controller 301 prompts a user to input the diameter of the media roll 4 and the thickness of the printing medium 2 and at S204 adopts an input value of the diameter of the media roll 4. At S205, the main controller 301 executes printing. At S206, the main controller 301 calculates the diameter of the media roll 4 after printing from the amount of the printing medium 2 used by printing and the thickness of the printing medium 2, and stores a calculated value of the diameter of the media roll 4 for calculation of the separation-point moving time in pull-back operation.

For the user's input of the diameter of the media roll, for example, the sheet feeding unit 101 may have a scale so that the user can read and input a value of the scale.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a media roll in which a printing medium having an adhesive face and no separation sheet on the adhesive face is wound in a roll shape;

an image forming device to form an image on the recording medium;

a conveyance unit including a conveyance rotator to convey the printing medium; and a controller to control the conveyance rotator and the media roll to rotate in reverse and pull back the printing medium to the media roll, in pulling back the printing medium to the media roll, the controller sets a linear velocity of the media roll in a rotation direction of the media roll to be not lower than a linear velocity of the conveyance rotator in a rotation direction of the conveyance rotator, wherein the controller controls a velocity difference between the linear velocity of the media roll and the linear velocity of the conveyance rotator to be Va from a start of pulling back the printing medium to when a separation point of the printing medium from the media roll reaches a tangent line of the media roll in an area between the media roll and the conveyance rotator, and wherein, when the separation point of the printing medium reaches the tangent line of the media roll, the controller switches the velocity difference from Va to Vb that is a smaller velocity difference than Va.

2. The image forming apparatus according to claim 1, further comprising a remaining amount detector to detect a roll diameter of the media roll, wherein the controller determines a timing of switching the velocity difference from Va to Vb in accordance with a detection result of the roll diameter with the remaining amount detector.

3. The image forming apparatus according to claim 2, wherein the remaining amount detector calculates the roll diameter from information on a rotation angle of the media roll and a detection result of a movement amount of an outer circumference of the media roll corresponding to the rotation angle.

4. The image forming apparatus according to claim 2, wherein the remaining amount detector calculates the roll diameter from an initial roll diameter of the media roll, a thickness of the printing medium, and an amount of the printing medium used for printing.

5. The image forming apparatus according to claim 1, further comprising a driving system to rotate the media roll, wherein the driving system includes a torque limiter to stop transmission of a drive force from the media roll when a torque applied from the media roll is equal to or greater than a threshold value.

* * * * *